US008001618B2

(12) United States Patent
Bay

(10) Patent No.: US 8,001,618 B2
(45) Date of Patent: Aug. 23, 2011

(54) VENTILATED DOUBLE-CLOSURE GARMENT

(75) Inventor: Marc A Bay, Farmington, MI (US)

(73) Assignee: Sullivans, Inc., Hanson, MA (US)

( * ) Notice: Subject to any disclaimer, the term of this patent is extended or adjusted under 35 U.S.C. 154(b) by 861 days.

(21) Appl. No.: 11/903,444

(22) Filed: Sep. 21, 2007

(65) Prior Publication Data

US 2009/0077710 A1 Mar. 26, 2009

(51) Int. Cl.
*A41D 1/02* (2006.01)
*A41D 3/02* (2006.01)

(52) U.S. Cl. ..... 2/93; 2/96; 2/97

(58) Field of Classification Search ..... 2/457, 92, 2/93, 96, 97, 101, 244, 267, DIG. 1
See application file for complete search history.

(56) References Cited

U.S. PATENT DOCUMENTS

| | | | |
|---|---|---|---|
| 317,711 | A | 5/1885 | Brinkmann |
| 367,921 | A | 8/1887 | Norton |
| 375,504 | A | 12/1887 | Norton |
| 385,306 | A | 6/1888 | Helwitz |
| 1,015,231 | A | 1/1912 | Jacobs |
| 1,164,386 | A | 12/1915 | Nicholas |
| 1,223,863 | A | 4/1917 | Freedman |
| 1,250,004 | A | 12/1917 | Philip |
| 1,359,999 | A | 11/1920 | McEvoy |
| 1,360,390 | A | 11/1920 | Gilfillan |
| 1,363,981 | A | 12/1920 | Jenkins et al. |
| 1,381,373 | A | 6/1921 | Waterman |
| 1,518,884 | A | 12/1924 | Weiner |
| 1,647,656 | A | 11/1927 | Olsen |
| 1,648,282 | A | 11/1927 | Schneider |
| 1,679,102 | A | 7/1928 | Thompson |
| 1,693,464 | A | 11/1928 | Quantz |
| 1,714,491 | A | 5/1929 | Burr |
| 1,721,403 | A | 7/1929 | Miller |
| 1,782,000 | A | 11/1930 | Collins |
| 1,818,811 | A | 8/1931 | Miller |

(Continued)

FOREIGN PATENT DOCUMENTS

BE 494309 3/1950

(Continued)

OTHER PUBLICATIONS

"Fieldsheer Air Speed Jacket", Advertisement from Parts & Accessories, MOTORCYCLEVILLE.COM, Year 2001 Model, (published Feb. 8, 2003) 1 page.

(Continued)

*Primary Examiner* — Alissa L Hoey
(74) *Attorney, Agent, or Firm* — Cesari and McKenna, LLP

(57) ABSTRACT

A ventilated and water-resistant garment is provided. The ventilated garment has at least one vent disposed in a wind-resistant protective material layer and has a closure to selectively permit fluid flow through the vent. A breathable material underlies the vent. The vent has a securing strap with a fastener that secures with a complementary fastener to ensure that the breathable material is substantially exposed to promote fluid flow through the breathable material. A pair of vents is preferably provided in the garment with each have a securing strap with a fastener that removably engages with the complementary fastener on the other securing strap to enhance flow through the vents. Further, double-vent water-resistant openings are provided, having a primary and a secondary closable opening, which can be offset from one another to enhance water and fluid impermeability while providing ventilation.

19 Claims, 9 Drawing Sheets

U.S. PATENT DOCUMENTS

| | | | | |
|---|---|---|---|---|
| 1,971,622 | A | | 8/1934 | Quackenbush |
| 1,973,421 | A | | 9/1934 | Wallace |
| 2,010,434 | A | | 8/1935 | Langrock |
| 2,073,711 | A | | 3/1937 | Robinsohn |
| 2,078,461 | A | | 4/1937 | Siegel |
| 2,079,980 | A | | 5/1937 | Anders |
| 2,084,173 | A | | 6/1937 | Wexler |
| 2,114,514 | A | | 4/1938 | York |
| 2,119,621 | A | | 6/1938 | Ferrone |
| D115,983 | S | | 8/1939 | Bailey |
| 2,186,918 | A | | 1/1940 | Wolf |
| D119,122 | S | | 2/1940 | Bauer |
| 2,259,560 | A | | 10/1941 | Glidden |
| 2,271,211 | A | | 1/1942 | Stockton |
| 2,291,861 | A | | 8/1942 | Astrove |
| 2,391,535 | A | | 12/1945 | Zelano |
| 2,458,004 | A | | 1/1949 | Kerr |
| 2,469,700 | A | | 5/1949 | Petrucelli |
| 2,505,451 | A | | 4/1950 | Weinstock |
| D160,800 | S | | 11/1950 | Mandelbaum |
| 2,551,245 | A | | 5/1951 | Cook |
| 2,585,840 | A | | 2/1952 | Reynolds |
| 2,615,224 | A | | 10/1952 | Shur |
| 2,637,086 | A | | 5/1953 | Philips |
| 2,644,946 | A | | 7/1953 | Menz et al. |
| 2,690,564 | A | | 10/1954 | Kingston et al. |
| 2,700,769 | A | | 2/1955 | Polchinski |
| 2,713,168 | A | * | 7/1955 | Bagnato ..... 2/93 |
| 2,715,226 | A | | 8/1955 | Weiner |
| 2,722,694 | A | | 11/1955 | Bryant |
| 2,800,699 | A | | 7/1957 | Armstrong |
| 2,989,754 | A | | 6/1961 | Bukspan |
| 3,045,243 | A | | 7/1962 | Lash et al. |
| 3,086,215 | A | | 4/1963 | Di Paola |
| 3,102,570 | A | | 9/1963 | Fairchilds |
| 3,153,793 | A | | 10/1964 | Lepore |
| 3,213,465 | A | | 10/1965 | Ludwikowski |
| 3,389,407 | A | | 6/1968 | Morrison |
| 3,448,463 | A | | 6/1969 | Milone |
| 3,536,083 | A | | 10/1970 | Reynolds |
| D220,822 | S | | 5/1971 | De Wan |
| 3,638,241 | A | | 2/1972 | Holmes |
| 3,691,564 | A | | 9/1972 | La Marre et al. |
| 3,706,102 | A | | 12/1972 | Grenier |
| 3,761,962 | A | | 10/1973 | Myers |
| 3,771,169 | A | | 11/1973 | Edmund |
| 3,801,987 | A | | 4/1974 | Thompson, Jr. |
| 3,921,224 | A | | 11/1975 | Ingram, III |
| 3,924,273 | A | | 12/1975 | Donovan |
| 3,969,772 | A | | 7/1976 | Pravaz |
| 4,004,294 | A | * | 1/1977 | Pinch ..... 2/104 |
| D248,896 | S | | 8/1978 | Hasday et al. |
| 4,112,556 | A | | 9/1978 | Flaum et al. |
| 4,122,553 | A | | 10/1978 | Pitkanen |
| 4,170,793 | A | | 10/1979 | O'Brien |
| 4,185,327 | A | | 1/1980 | Markve |
| 4,195,362 | A | | 4/1980 | Rolando |
| 4,286,337 | A | | 9/1981 | Malouf, Jr. |
| 4,384,369 | A | | 5/1983 | Prince |
| 4,390,996 | A | | 7/1983 | Read |
| 4,397,043 | A | | 8/1983 | Croteau |
| 4,408,356 | A | | 10/1983 | Abrams |
| 4,422,186 | A | | 12/1983 | Loney |
| 4,513,451 | A | | 4/1985 | Brown |
| 4,547,904 | A | | 10/1985 | Long et al. |
| 4,554,682 | A | | 11/1985 | Hillquist |
| 4,563,777 | A | | 1/1986 | Park |
| 4,569,089 | A | | 2/1986 | Nesse |
| 4,608,715 | A | | 9/1986 | Miller et al. |
| 4,665,563 | A | | 5/1987 | Harvey |
| 4,722,099 | A | | 2/1988 | Kratz |
| 4,731,883 | A | | 3/1988 | Foster |
| 4,774,725 | A | * | 10/1988 | Page ..... 2/81 |
| 4,783,858 | A | | 11/1988 | Chevalier |
| 4,858,249 | A | * | 8/1989 | Stewart ..... 2/305 |
| D306,511 | S | | 3/1990 | Jones |
| D308,435 | S | | 6/1990 | Kushitani |
| 4,995,115 | A | | 2/1991 | Ellis |
| 4,996,723 | A | | 3/1991 | Huhn et al. |
| 5,031,244 | A | | 7/1991 | Inagaki |
| 5,097,535 | A | | 3/1992 | Dye et al. |
| 5,105,477 | A | | 4/1992 | Golde |
| 5,105,478 | A | | 4/1992 | Pyc |
| 5,115,516 | A | | 5/1992 | Golde |
| 5,133,086 | A | | 7/1992 | Truitt et al. |
| 5,159,719 | A | | 11/1992 | Aumann |
| D332,342 | S | | 1/1993 | Dye et al. |
| 5,201,075 | A | | 4/1993 | Svetich |
| 5,303,424 | A | | 4/1994 | Cromartie |
| 5,398,343 | A | | 3/1995 | Kuracina |
| 5,507,042 | A | | 4/1996 | van der Slessen |
| 5,555,562 | A | | 9/1996 | Holt et al. |
| 5,592,691 | A | | 1/1997 | Ronald |
| 5,603,646 | A | | 2/1997 | Tobias |
| 5,640,715 | A | | 6/1997 | Adams |
| 5,642,526 | A | | 7/1997 | Thompson |
| 5,687,423 | A | | 11/1997 | Ross |
| 5,704,064 | A | | 1/1998 | van der Sleesen |
| 5,718,000 | A | | 2/1998 | Ost et al. |
| 5,752,277 | A | | 5/1998 | van der Sleesen |
| 5,774,891 | A | | 7/1998 | Boyer |
| 5,799,330 | A | | 9/1998 | O'Donoghue-Kitt |
| 5,829,059 | A | | 11/1998 | Covington, Jr. |
| 5,845,336 | A | | 12/1998 | Golde |
| 5,850,634 | A | | 12/1998 | Toombs |
| 5,884,332 | A | | 3/1999 | Snedeker |
| 5,890,225 | A | | 4/1999 | Marschall |
| 5,924,135 | A | | 7/1999 | Worth |
| 5,940,879 | A | | 8/1999 | Whitehouse |
| 5,978,960 | A | | 11/1999 | Wrightman |
| 6,018,819 | A | | 2/2000 | King et al. |
| 6,052,826 | A | | 4/2000 | Tolton |
| 6,070,274 | A | | 6/2000 | van der Sleesen |
| 6,081,925 | A | * | 7/2000 | Reiber ..... 2/125 |
| 6,085,353 | A | | 7/2000 | van der Sleesen |
| 6,092,266 | A | | 7/2000 | Lee |
| 6,105,214 | A | | 8/2000 | Press |
| 6,119,270 | A | | 9/2000 | Chou |
| 6,125,472 | A | * | 10/2000 | Nakagawa ..... 2/115 |
| 6,163,883 | A | | 12/2000 | Hong |
| D437,673 | S | | 2/2001 | DesJardins et al. |
| 6,223,349 | B1 | | 5/2001 | Roiser |
| 6,237,152 | B1 | | 5/2001 | Gootrad |
| 6,253,379 | B1 | | 7/2001 | Collier |
| 6,260,196 | B1 | | 7/2001 | van der Sleesen |
| 6,263,510 | B1 | | 7/2001 | Bay et al. |
| 6,263,511 | B1 | | 7/2001 | Moretti |
| 6,272,691 | B1 | * | 8/2001 | Henricksen et al. ..... 2/338 |
| 6,298,485 | B1 | | 10/2001 | Heller |
| 6,339,843 | B1 | | 1/2002 | Grilliot et al. |
| 6,339,845 | B1 | | 1/2002 | Burns et al. |
| 6,360,371 | B1 | | 3/2002 | Davey |
| 6,405,377 | B1 | | 6/2002 | Davis |
| 6,421,834 | B2 | | 7/2002 | Kester |
| 6,427,242 | B1 | | 8/2002 | Bush et al. |
| 6,427,294 | B1 | | 8/2002 | Shibaike et al. |
| 6,438,757 | B1 | | 8/2002 | Quinn |
| 6,460,185 | B1 | | 10/2002 | Hardy |
| 6,490,734 | B2 | | 12/2002 | Blauer et al. |
| D479,902 | S | | 9/2003 | Brown |
| 6,651,254 | B1 | | 11/2003 | Chang |
| 6,675,389 | B1 | | 1/2004 | Kublick |
| 6,684,408 | B2 | | 2/2004 | Rindle et al. |
| 6,745,400 | B1 | | 6/2004 | Paciorkowski |
| 6,775,846 | B1 | * | 8/2004 | LaFauci et al. ..... 2/125 |
| 6,792,621 | B2 | | 9/2004 | Braun |
| 6,792,622 | B2 | | 9/2004 | Graves |
| 6,795,976 | B1 | | 9/2004 | van der Sleesen |
| 6,802,082 | B2 | | 10/2004 | Watley |
| D498,037 | S | | 11/2004 | Bay |
| 6,848,119 | B2 | | 2/2005 | Crye et al. |
| 6,851,128 | B1 | | 2/2005 | Parrotte |
| 6,854,130 | B2 | | 2/2005 | van der Sleesen |
| 6,868,557 | B1 | | 3/2005 | van der Sleesen |
| 6,868,558 | B2 | * | 3/2005 | Majerfeld ..... 2/96 |
| 6,883,178 | B2 | | 4/2005 | van der Sleesen |
| 6,941,584 | B1 | | 9/2005 | Matthews |

| | | | | |
|---|---|---|---|---|
| 6,961,962 | B1 | 11/2005 | Lewis | |
| 6,968,573 | B2 | 11/2005 | Silver | |
| 7,017,191 | B2 | 3/2006 | Golde | |
| 7,039,958 | B2 * | 5/2006 | Henricksen | 2/338 |
| 7,043,767 | B2 | 5/2006 | Jaeger | |
| 7,082,648 | B2 | 8/2006 | Morioka et al. | |
| 7,111,328 | B2 | 9/2006 | Bay | |
| 7,162,779 | B2 | 1/2007 | MacHacek | |
| 7,171,695 | B2 | 2/2007 | Braun | |
| 7,181,810 | B2 | 2/2007 | Fernando | |
| 7,197,772 | B2 | 4/2007 | Crye et al. | |
| 7,412,728 | B2 * | 8/2008 | Alesina et al. | 2/93 |
| 2003/0033656 | A1 * | 2/2003 | Jaeger | 2/69 |
| 2004/0055069 | A1 | 3/2004 | Clarke Fayle et al. | |
| 2004/0139528 | A1 * | 7/2004 | Hord | 2/96 |
| 2004/0143884 | A1 * | 7/2004 | Majerfeld | 2/96 |
| 2005/0015843 | A1 | 1/2005 | Roux et al. | |
| 2005/0102729 | A1 * | 5/2005 | Snedeker | 2/96 |
| 2005/0235392 | A1 | 10/2005 | Bay | |
| 2007/0094852 | A1 | 5/2007 | Wang | |
| 2009/0265829 | A1 * | 10/2009 | Gomes Seguin et al. | 2/87 |

FOREIGN PATENT DOCUMENTS

| | | |
|---|---|---|
| CA | 2344726 | 10/2002 |
| DE | 517523 | 1/1931 |
| EP | 0 000 095 | 12/1978 |
| EP | 0 034 518 | 1/1981 |
| EP | 0 071 226 | 2/1983 |
| EP | 0 161 564 | 11/1985 |
| EP | 0 412 450 | 2/1991 |
| EP | 0 643 929 | 3/1995 |
| EP | 0 819 389 | 1/1998 |
| EP | 0 870 745 | 10/1998 |
| EP | 0 913 170 | 6/1999 |
| EP | 0 974 277 | 1/2000 |
| EP | 1 329 167 | 7/2003 |
| FR | 1 029 851 | 3/1953 |
| FR | 1 220 511 | 1/1960 |
| FR | 2 094 362 | 1/1972 |
| FR | 2 127 140 | 9/1972 |
| FR | 2 413 052 | 12/1977 |
| FR | 2 460 634 | 7/1979 |
| FR | 2 546 759 | 12/1984 |
| FR | 2 783 138 | 3/2000 |
| GB | 461247 | 2/1937 |
| GB | 2 104 770 | 3/1983 |
| JP | 59-4722 | 1/1984 |
| JP | 08-284009 | 10/1996 |
| WO | WO 94/00036 | 1/1994 |
| WO | WO 96/39056 | 12/1996 |
| WO | WO 02/01977 | 1/2002 |
| WO | WO 02/060287 | 8/2002 |

OTHER PUBLICATIONS

"Fieldsheer" Advertisement from FIELDSHEERONLINE.COM, showing Fieldsheer Mach 1, Mach 2, Sonic Air, Titanium Air, Highland Suit, Highland 2, Kiri, Manx Pro, Spiga, Thistle, XPack Tech, Cabrio, Latrak jackets; http://store.fieldsheer.com, (Feb. 8, 2003), 24 pages.

"Joe Rocket" Catalog, Spring 2002, (published 2002), Cover page and pp. 4-5, 13, 32 and 35.

"Steve Largent Autographed Football Jersey Mesh", Advertisement from COLLECTIBLES.GOANTIQUES.COM, 1996-2003, (published Feb. 8, 2003), 1 page.

2000 Motorcyle—Joe Rocket® brochure, back page and p. 5 ("Bulldog" jacket), published in 1999.

2001 Kushitani Riding Equipment Collection, 2001, 9 pages.

Accessories Collection, Specialty Sports Limited, http:www.tecknicgear.com/main_r1.htm, Apr. 26, 2000, 4 pages.

AGV Aeromesh Textile Jacket, www.agvsport.com (2004).

Cabela's Master Catalog, Fall 1998, pp. 50-51.

Drawing of Fieldsheer Jacket with removable torso vest (offered for sale or publicly used prior to Feb. 13, 2003), 1 page.

European Search Report for EP 03 29 1709 dated Jun. 15, 2005, 2 pages.

Five photographs of Joe Rocket® "Bulldog" jacket (offered for sale before 2003).

Japanese publications with English translation entitled "Proto War-RJ" citing Kiss Racing (believed to have been published in 2000), 3 pages.

Red Head, Fall 1999, Specialist Catalog, p. 17.

* cited by examiner

VENTILATED DOUBLE-CLOSURE GARMENT

FIELD

The present disclosure relates to a garment and more particularly to a ventilated protective garment.

BACKGROUND

Garments, such as jackets and combined pant/jacket racing suits, are commonly used by people operating motor sport vehicles, such as a motorcycle, all-terrain vehicle or snowmobile. Such jackets and suits commonly employ an outer shell covering the complete torso and arms of the person, and an inner insulating liner which can be removed for warm weather use. For example, reference should be made to U.S. Pat. Nos. 6,263,510 entitled "Ventilating Garment," which issued on Jul. 24, 2001 to Bay et al. and 7,111,328 entitled "Hybrid Ventilating Garment," which issued on Sep. 26, 2006 to Bay. These patents are herein respectively incorporated by reference in their entireties.

It is beneficial to continually improve ventilation in such garments. Furthermore, it is beneficial to improve garments which provide ventilation by providing protection from undesired fluid penetration (e.g., air and water), which might potentially enter ventilated portions of the garment, including through seams, zippers, and vents, even when the vents and openings are closed. Improvements in ventilation of protective garments, while maintaining good crash safety performance are also desirable.

SUMMARY

In accordance with the present invention, a ventilated and water-resistant garment is provided. In one aspect of the present invention, a ventilated garment includes at least one closable vent disposed in a wind-resistant protective material having a breathable material layer underlying the vent, with a securing strap having a first fastening member that is removably engageable with a complementary second fastening member. When the first and second fastening members are engaged and secured together, the securing strap substantially exposes the breathable material layer to promote fluid flow through the vent.

A further aspect of the present invention employs a vent in a material layer that is water-resistant and wind-resistant and includes a primary opening and a secondary opening disposed between the primary opening and a breathable material. The primary opening is closable by a primary water-impermeable zipper closure bonded to the material layer and the secondary opening is closable by a secondary water-impermeable zipper closure. Yet another feature of the present invention is where the primary opening is laterally offset from the secondary opening to provide further impenetrability of the vent to fluid flow.

In yet other aspects of the present invention, a ventilated garment is provided that includes at least one pair of substantially parallel closable vents disposed in a wind-resistant protective material layer. The pair of vents have a first and second securing strap with a first fastening member and a second fastening member respectively, which are removably engageable with one another to substantially expose a breathable material layer beneath each respective vent. In certain aspects, the pair of vents are formed on the front torso region of a jacket. In certain aspects, the pair of vents are formed on the back torso region of a jacket. In another preferred aspect, a first pair of vents are disposed on the front of a jacket and a second pair of vents are disposed on the back of the jacket, so that fluid flow is promoted through the jacket for ventilation.

The present disclosure provides a ventilated garment that is advantageous over traditional garments in that various features of the disclosure provide thorough ventilation through the garment, for example, through the torso region of a motorcycle jacket, while ensuring water-resistance including in the region near the vents. The ventilation is improved for hot conditions, in that the securing straps provided in accordance with the principles of the present disclosure ensure exposure of a substantial region of the breathable material disposed beneath the vent. Moreover, the present disclosure is advantageous by ensuring that the vents are water and fluid impermeable during wet and/or cold weather conditions. In certain aspects, the water-resistant vents include primary and secondary openings disposed over a breathable material layer and securing straps ensure adequate exposure of the breathable material, even during riding conditions at high speeds. Yet such vents have superior resistance to fluid penetration, which might otherwise occur while driving at high speeds in driving rain. Further areas of applicability will become apparent from the description provided herein. It should be understood that the description and specific examples are intended for purposes of illustration only and are not intended to limit the scope of the present disclosure.

DETAILED DESCRIPTION

Figure 1:
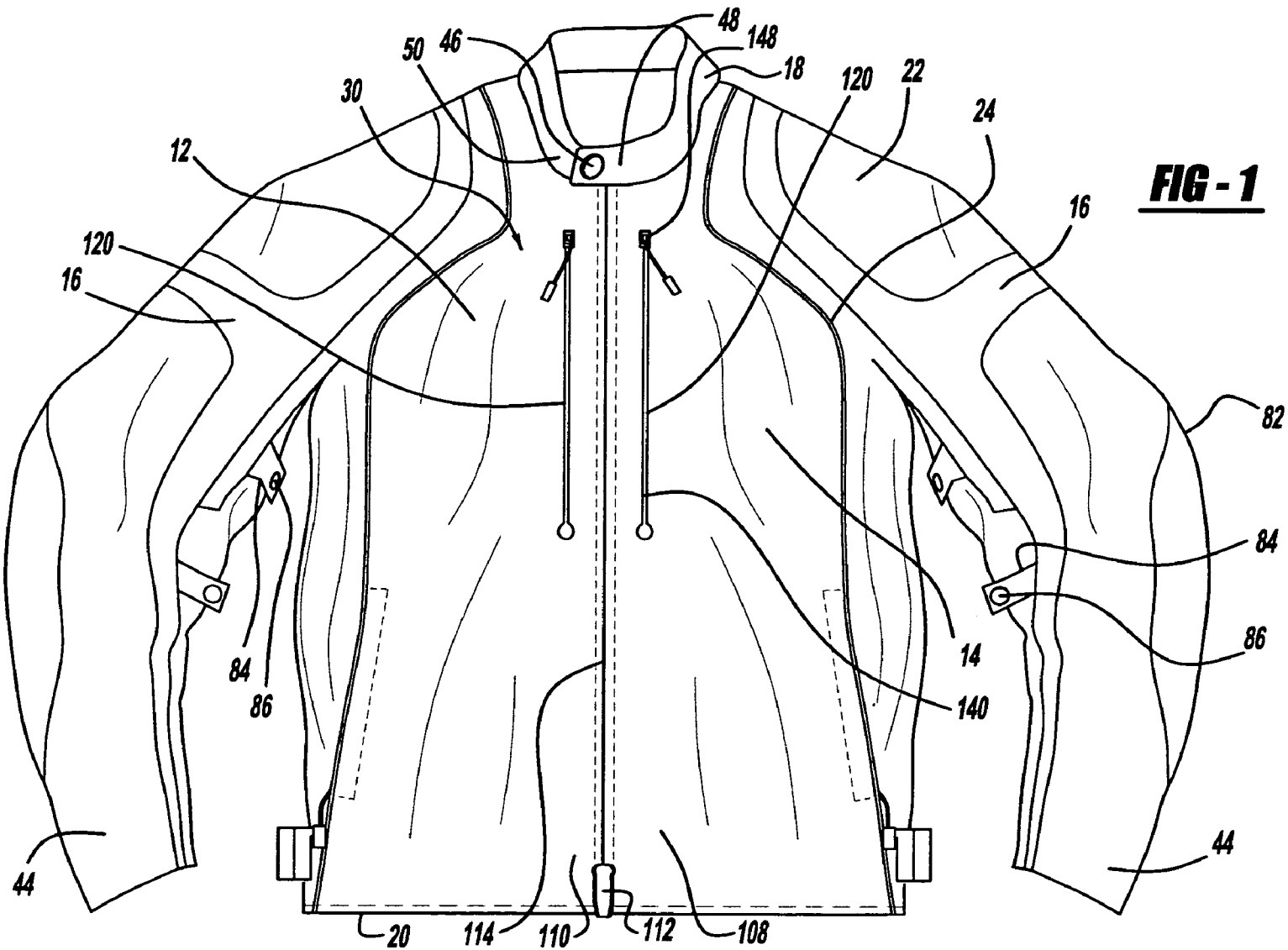
FIG. 1 is a front elevational view of the preferred embodiment of a garment according to the principles of the present invention, with a pair of front vents on the upper torso region.

The following description is merely exemplary in nature and is not intended to limit the present disclosure, application, or uses. It should be understood that throughout the drawings, corresponding reference numerals indicate like or corresponding parts and features.

The present invention pertains to protective garments, such as jackets, pants, and jump and/or race suits. In various aspects, the present disclosure provides a ventilated protective garment, such as an exemplary motorcycle, biking, snowmobile or all-terrain vehicle jacket 10 shown generally in FIGS. 1-3, 6-7, and 9. While not shown, the principles of the present teachings are applicable to a variety of garments, including protective motorcycle pants and motorcycle race suits (having combined or integral pants and jacket portions). However, the concept is demonstrated herein in the context of the representative jacket 10. Conventional protective garment materials are typically dense, abrasion-resistant, wind-resistant, and often water-resistant and/or water-proof, thus, the weight and lack of breathability can cause overheating of a rider wearing such a garment. Further, high velocity air flow may cause non-ventilated protective garments to undesirably inflate and billow, as will be discussed in more detail below. Thus, ventilated protective garments are desirable for use in various weather conditions, especially during hot and humid weather. Yet it is also desirable that the same protective garment is versatile and useful in a variety of weather conditions, including in cold or wet conditions. Thus, in accordance with the principles of the present disclosure, a ventilated protective garment is provided that has superior safety, impact, and abrasion-resistance, while further having improved ventilation that can be easily adjusted by the garment wearer, while simultaneously providing improved water-resistance and insulation from the elements as desired.

Figure 6:
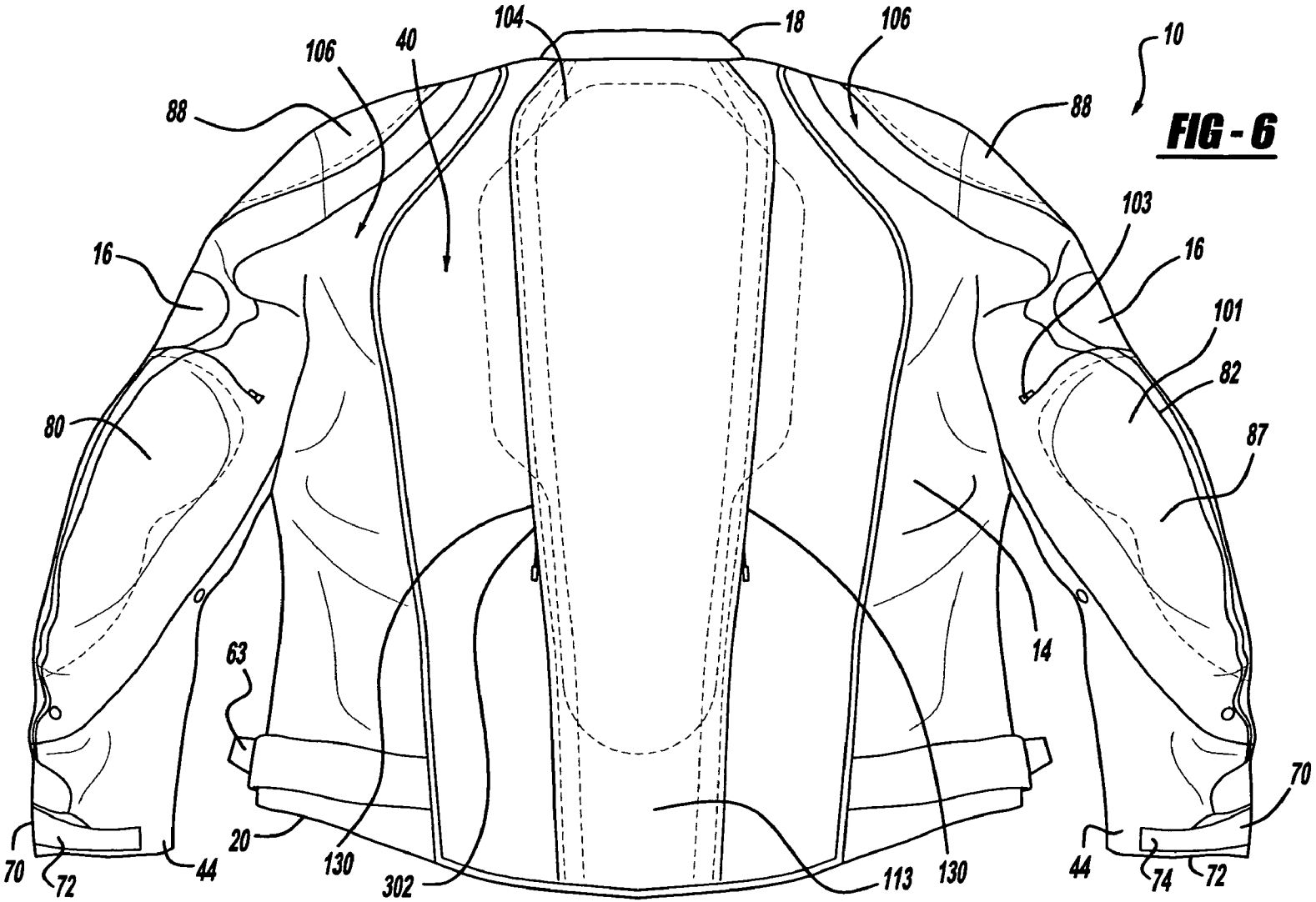
FIG. 6 is a rear elevational view showing the embodiment of FIG. 1 having a pair of back vents shown in their closed position.
Figure 7:
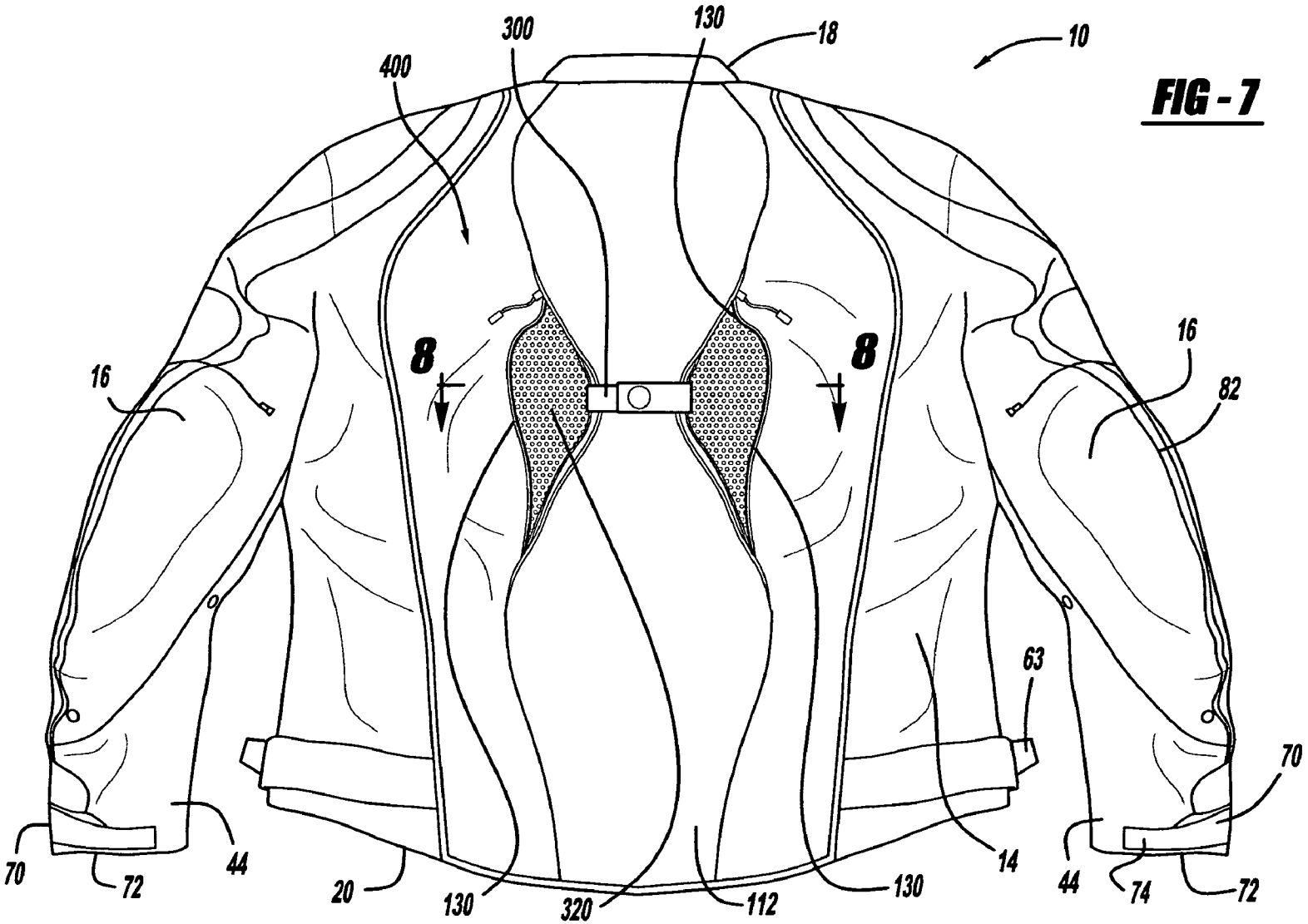
FIG. 7 is a rear elevational view showing a pair of securing straps fastened and secured to expose a breathable material panel for the back vents of FIG. 6.

Jacket 10 is formed of an outer protective material layer 12 (best seen in FIG. 11), which, as shown generally in FIGS. 1-3, 6-7, and 9, forms a torso 14 and arm portions or sleeves 16. Torso 14 optionally includes a collar 18 for a wearer's neck and a waist 20. Torso region 14 has a front 30 (FIGS. 1-3, 9) and a back 40 (FIGS. 6-7). Jacket 10 includes two sleeves 16, each having a first end 22, which is attached to respective openings in side regions 24 of torso 14. Generally, sleeves 16 are attached to torso 14 via a circumferential water-tight seam (not shown) between upper first end 22 of sleeves 16 and an opening of torso 14. Except where otherwise noted, seams attaching various pieces and components of jacket 10, which are externally exposed, are preferably water-resistant and most-preferably water-proof or water-impermeable. Each sleeve 16 terminates in a cuff 44 or opening at its distal end.

In various aspects, various openings of jacket 10, such as cuff 44, collar 18, sleeves 16, and waist 20, optionally include adjustable closures, such as components or materials that contract or cinch to provide a close-fit around the limbs, torso, and neck of the wearer, for example. Such features are particularly beneficial for applications where the wearer experiences high-wind forces when wearing the garment. High-speed fluid flow (e.g., air and water) passing by the rider may cause billowing when air flows into the garment through various openings causing the garment to inflate and flap, which can be a nuisance to the rider. Ventilation and restriction of the garment openings can minimize billowing or control it to a desired level. Various adjustable closure mechanisms and systems may range from elastic materials to fasteners and adjustable cinching mechanisms. For example, collar 18 optionally includes a fastener 46 to close a first side 48 of collar 18 to a second side 50. As shown, fastener 46 of jacket 10 includes a snap having a female snap component on first side 48 and a male snap component on second side 50 for removably mating and securing fastener 45. However, other suitable fasteners and closures are contemplated for these fasteners and any others discussed herein, including, for example, hook and eye fasteners, hook and loop fasteners (Velcro), zipper closures, buttons, barb closures, and the like. In this manner, collar 18 can be adjusted allowing variable diameter neck closure.

Similarly, waist 20 can be adjusted to tighten or loosen around the body of a wearer by adjustable cinching mechanisms 52. As shown in FIGS. 1-3 and 6-7, adjustable cinching mechanism 52 includes a square-double ring glide member 60 attached to jacket 10 at a side region 24 near waist 20 and further receives a flexible fabric fastening strap 62 attached to back 40 of the jacket (FIG. 7). A terminal end 63 of fastening strap 62 is looped through the square-ring glide member 60 folding onto itself, where its length can be adjusted to a desired position. At least one side of fastening strap 62 optionally includes a receiving portion of hook and loop material along a receiving region 66 and a complementary fastening region 68 disposed on a surface at terminal end 63 of strap 62 for securing the strap on itself. Thus, when fastening strap 62 is looped around the square-ring glide member 60 and turned on itself, its length can be adjusted and then secured via attachment of complementary fastening region 68 to receiving region 66. However, other forms of cinching mechanisms or means to secure fastening strap 62 are contemplated, including various fasteners or belt-like configurations. For example, while not shown, a pair of elasticized pull cords externally held together at each end by a compressible polymeric toggle and fabric tab can be used for cinching waist 20, as well. An optional pant zipper (not shown) is horizontally sewn across an inside surface of waist 20 at a back of the torso segment for removable zip attachment to jacket 10.

FIGS. 6 and 7 depict cuffs 44 having a cuff adjustment 70 disposed adjacent a distal open end 72 of each sleeve 16 which corresponds to a wrist area of the user. Each cuff adjustment 70 includes a securing assembly with a flexible piece of triangularly-shaped fabric sewn between a cuff fastening member 74 (not shown), such as those described in U.S. Pat. No. 7,111,328 to Bay entitled "Hybrid Ventilated Garment," incorporated herein by reference in its entirety. As shown, the cuff fastening member 74 is a flexible strap having either a receiving or attaching hook and loop material on a first side, which mates with a complementary hook and loop material (i.e., receiving or attaching depending on the selection of the material) disposed on cuff 44 to provide a desired cuff 44 diameter. As described in the context of other fastening means above, a variety of fasteners are contemplated, including a zipper, snaps, interlocking barb, hook and eye fasteners, buttons and other disengageable fasteners can be employed instead of hook and loop straps. In certain aspects, hook and loop fasteners and zippers provide enhanced wind blocking, by providing good sealing integrity. However, cuffs 44 can be expanded when cuff fastening member 74 is unsecured.

In the embodiment shown in FIGS. 1-3 and 6-7, a pair of sleeve adjustments 80 are located on each sleeve 16 adjacent an elbow area 82. Each sleeve diameter adjustment 80 includes a flexible tab 84 upon which is mounted a female snap attachment 86. A pair of spaced apart, male snap attachments (not shown) protrude from sleeve 16 for selective attachment at different positions with female snap attachment 86. The positioning of cuff adjustments 70 and sleeve adjustments 80 permits adjustment and positioning of body armor (to be discussed in more detail below) within sleeve 16, such as elbow pads 87 and shoulder pads 88 (FIG. 6). Further, adjustable closures at the various openings of a garment are highly advantageous because they allow the same jacket to be worn by the wearer regardless of whether jacket 10 is in a fully closed, wind blocking mode or in a fully ventilated mode.

An outer layer shell 100 of jacket 10 is desirably formed of protective material 12, which is abrasion-resistant and wind-resistant. Desirably, protective material 12 is water-resistant and/or water-proof. The outer shell 100 forms the torso 14 and sleeve 16 regions. The material 12 of outer shell 100 is preferably dense, wind-resistant and ultraviolet light blocking. In certain embodiments, the protective material 12 is water-resistant and/or water-proof. Suitable examples include a polyester fabric having a polyurethane internal coating. Such polyester fabrics are preferably dense and may have a representative denier of about 600. Other suitable abrasion and wind-resistant materials include nylon-based materials, such as TASLAN™ or CORDURA™ fabrics, both commercially available from E. I. du Pont de Nemours and Company Corp., of Wilmington, Del. Water-resistant and/or water-proof materials may be provided with a surface treatment, for example, a polyurethane coating for water-proofing on fabric or may deter water penetration due to the properties of the material selected. Additional PVC, polyurethane, or other waterproof coatings may be provided on any of the fabric layers to provide water resistance or waterproofing.

Optionally, the outer shell 100 includes the exposed protective material 12, but also includes an inner layer (not shown) made from a liner material, such as a perforated or mesh liner. The inner layer can be formed of a polyester mesh material, which is locally sewn to the inside of wind resistant outer protective material 12. The inner layer may be present and attached to substantially all of internal surface of the outer shell 100. In alternate embodiments, the inner layer is present in discrete regions corresponding to the inner surface of the outer shell 100. Other liners or layers are included beneath the outer shell 100 and optional inner layers may also be included. For example, a wind and/or water resistant removable inner liner, an insulating liner, and/or a removable inner lining jacket (not shown) are disposed within the outer shell 100. Such inner jackets and liners are preferably removable by fastening devices. However, in certain alternate embodiments, inner jackets or liners are permanently attached to an interior of jacket 10.

Crash absorbing padding, also known as body armor, is included in regions of the garment corresponding to certain regions of the wearer's body. A pair of pre-formed, convex shoulder pads 88 (FIG. 6) are internally attached within pockets sewn to mesh inner layer. For example, in certain embodiments, the inner layer is present at each side of shoulder segment to form a pocket of mesh material (not shown) which assists in retaining shoulder pads 88 in proximity to the outer shell 100. The pockets are closed at a top edge by hook and loop-type fasteners. In the preferred embodiment of FIG. 6, a pocket 101 is formed for receiving elbow pads 87 within the protective material 12 of outer shell 100. The pocket 101 opening is closed by a zipper closure 103. However, other alternate embodiments may have pre-formed elbow pads 87 optionally inserted into internal pockets sewn to an inside of inner layer/liner, which are closed by hook and loop-type fasteners.

A preformed, waffle-patterned, spine pad 104 is similarly removably positioned in a pocket formed by an inner layer of mesh material and held adjacent to the protective material 12 of outer shell 100. The preformed pads are preferably molded from multi-layer composite, resin-based foam-like materials. Some of the body armor pieces disclosed herein, can be readily substituted or supplemented by rigid polymeric panels having flat or three-dimensionally curved shapes.

Outer shell 100 includes left and right sleeve halves 106 which include attached sleeves 16 that are sewn to torso portion 14 of jacket 10 from front 30 to back 40 (See for example, FIGS. 1-2 and 6-7). In front 30 of jacket 10, torso portion 14 is bifurcated into a first torso side 108 and a second torso side 110 from collar 18 to waist 20. A main zipper 112 vertically extends along a front torso centerline opening 114 and includes a pair of parallel zipper tracks with teeth each on a respective stringer tape and a zipper pull, which closes respective first and second torso sides 108, 110 of torso 14. All zipper closures discussed herein have similar structure and functionality, and may include two-way zippers with two zipper slide pulls. When main zipper closure 112 closes the centerline opening 114, it desirably forms a water and air-tight seal.

In accordance with various principles of the present invention, a pair of front vents 120 is provided in the upper chest region of both first and second sides 108, 110 of torso portion 14 flanking centerline opening 114. Torso 14 further includes a mid-back section 113, which includes a pair of back vents 130 in accordance with the present invention.

Figure 2:
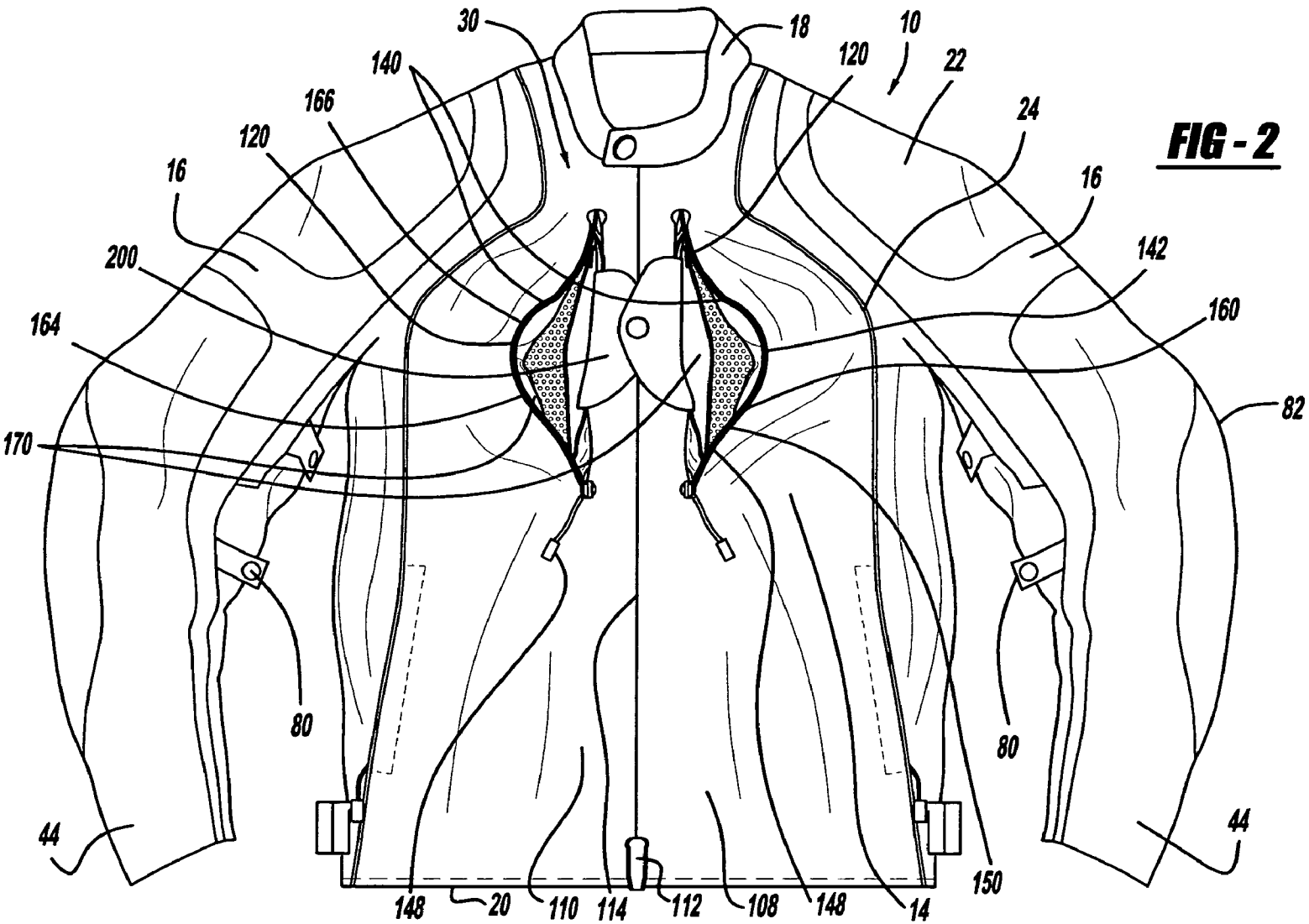
FIG. 2 is a front elevational view of the embodiment shown in FIG. 1 with the pair of front vents opened and a pair of securing straps fastened and secured to expose a breathable material panel.

Front vents 120 are openings in the outer shell 100 and each respectively include a first closure 140, preferably a zipper, to close a front vent opening 142 (FIG. 2). In certain aspects, first closure 140 is preferably water-resistant and/or water-proof. However, such closures do not necessarily require the integrity of closures used in conjunction with diving equipment and wet suits, for example, which are considered to be "water-proof" even at significant depths and pressures. In the context of motorcycle garments, water-resistant closures that resist water or fluid migration therethrough for a motor vehicle rider are contemplated. Thus, as used herein, "water-impermeable" is used to refer to a closure that resists and/or prevents water penetration therethrough, even at wind forces corresponding to those of a rider at high speeds on a motor vehicle.

Figure 4:
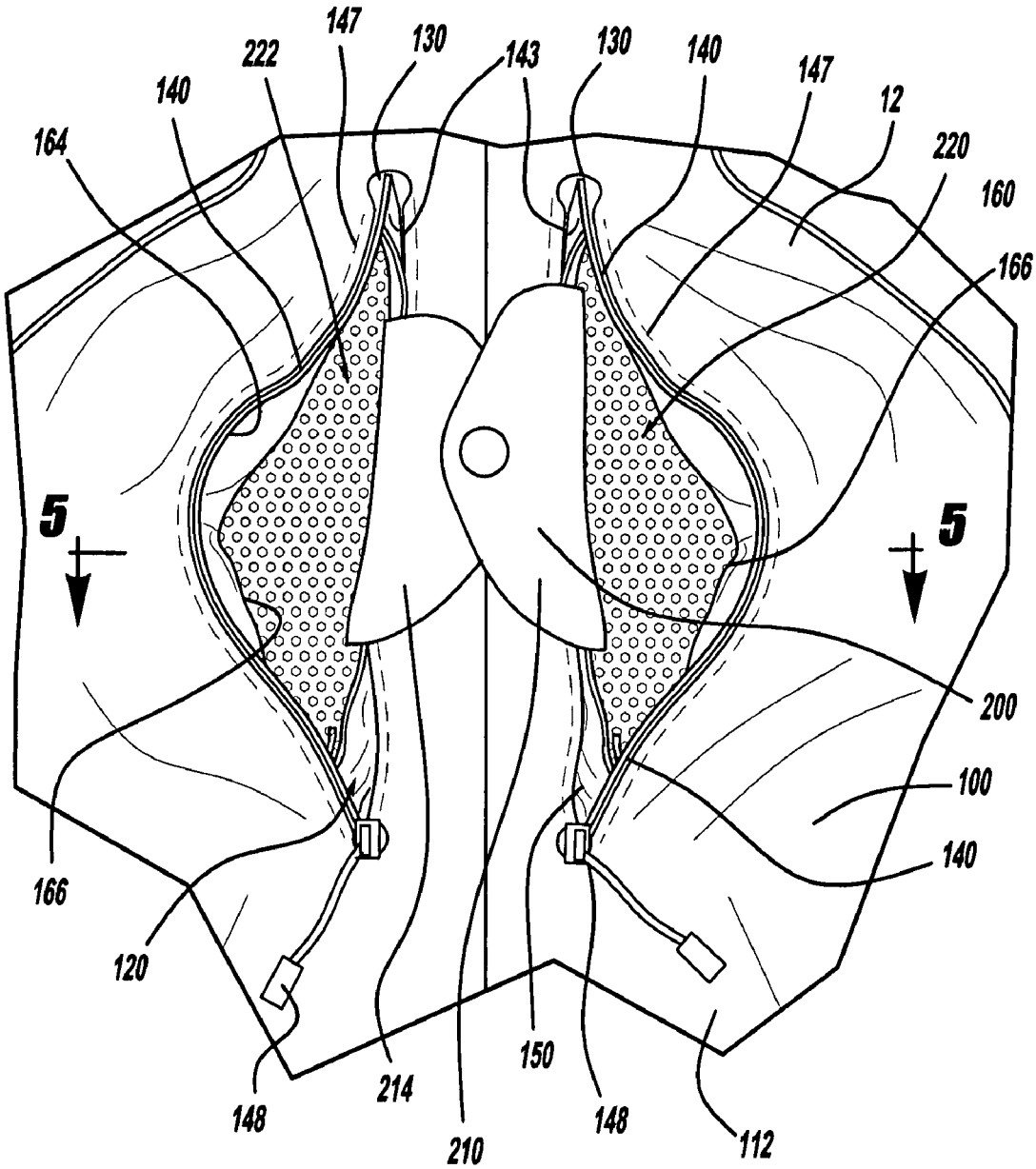
FIG. 4 is an enlarged and exaggerated front elevational view of the pair of front vents shown in FIG. 2.
Figure 10:
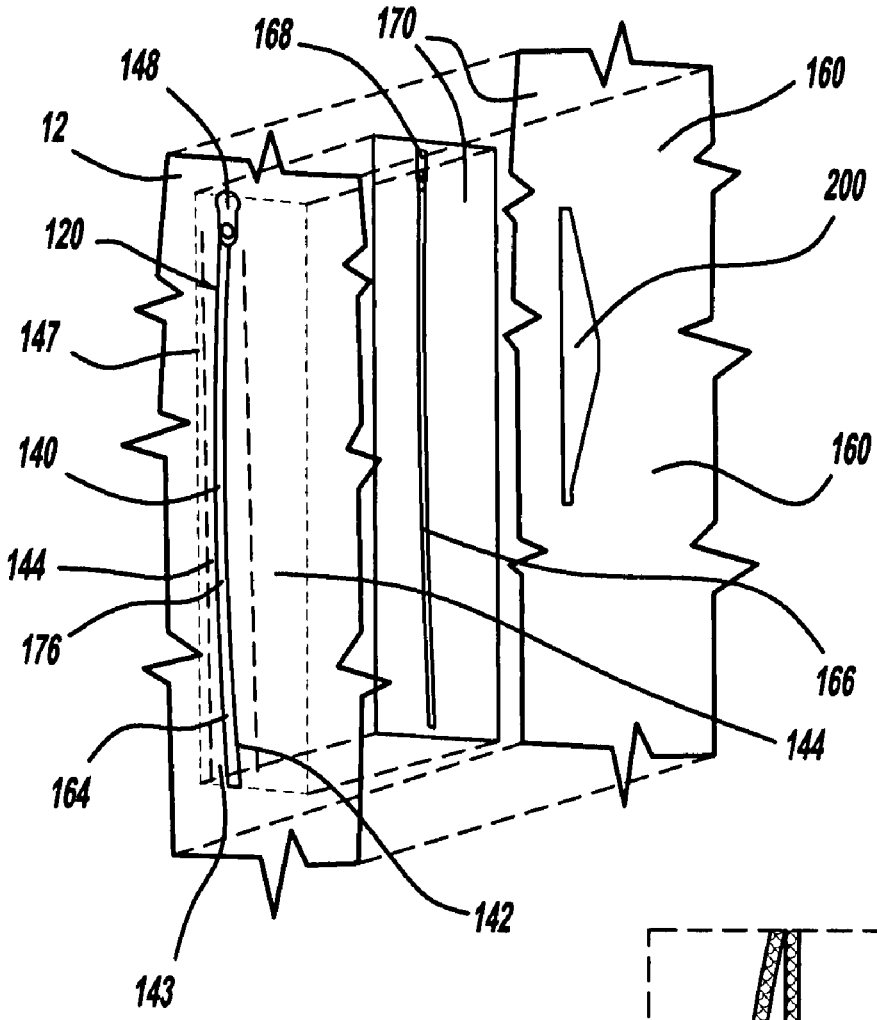
FIG. 10 is an exploded and enlarged partial view of the material layers forming the water-impermeable front vents of FIG. 9.

In preferred embodiments, first closure 140 is formed of water-impermeable stringer tapes having zipper tracks that interlock in a sealing manner to minimize and/or prevent fluid penetration. Further, it is preferred that at least a portion of first closure 140 is sealingly bonded to respective sides 144 of the protective material 12 into which vent 142 is disposed (FIGS. 4 and 10 show a detailed view of the front opening with a general bonding region 143). Such a sealing bond may be formed via adhesive and/or by applying pressure and/or heat to the regions to be joined. First closure 140 includes a zipper slide 148 that is movable from a first position to minimize and/or prevent fluid (water and air) flow through front vent 120 to a second open position where fluid is at least partially permitted and promotes flow through vent opening 120. In such aspects, zipper slide 148 of first closure 140 can be adjusted along its length to restrict relatively greater or lesser amounts of fluid flow into front vent 120, thus providing enhanced or reduced ventilation through front 30 of jacket 10, depending upon riding conditions. In preferred embodiments, a portion of the first closure 140 is attached via a second attachment method aside from the bonding process, for example, a hidden sewn seam 147 may be formed between the protective material 12 and first closure 140 for additional structural integrity. As can be best seen in FIGS. 4 and 5, the bonding regions 143 are disposed along the lateral edge regions of zipper tracks of the first closure 140. The hidden seam 147 is disposed outwards from the zipper tracks of the first closure 140 and from the bonding region 143. Hidden seam 147 does not extend through outer material 12. Various water-impermeable materials for use in conjunction with first closure 140 components include natural or synthetic water-resistant materials, such as by way of non-limiting example, polyvinylchloride (PVC), polyethylene, polypropylene, rubber, polyurethane, fluoropolymer, such as polytetrafluoroethylene (PTFE), and the like. Further, water-resistant films may be coated or laminated onto various materials to provide water-resistant properties.

Figure 3:
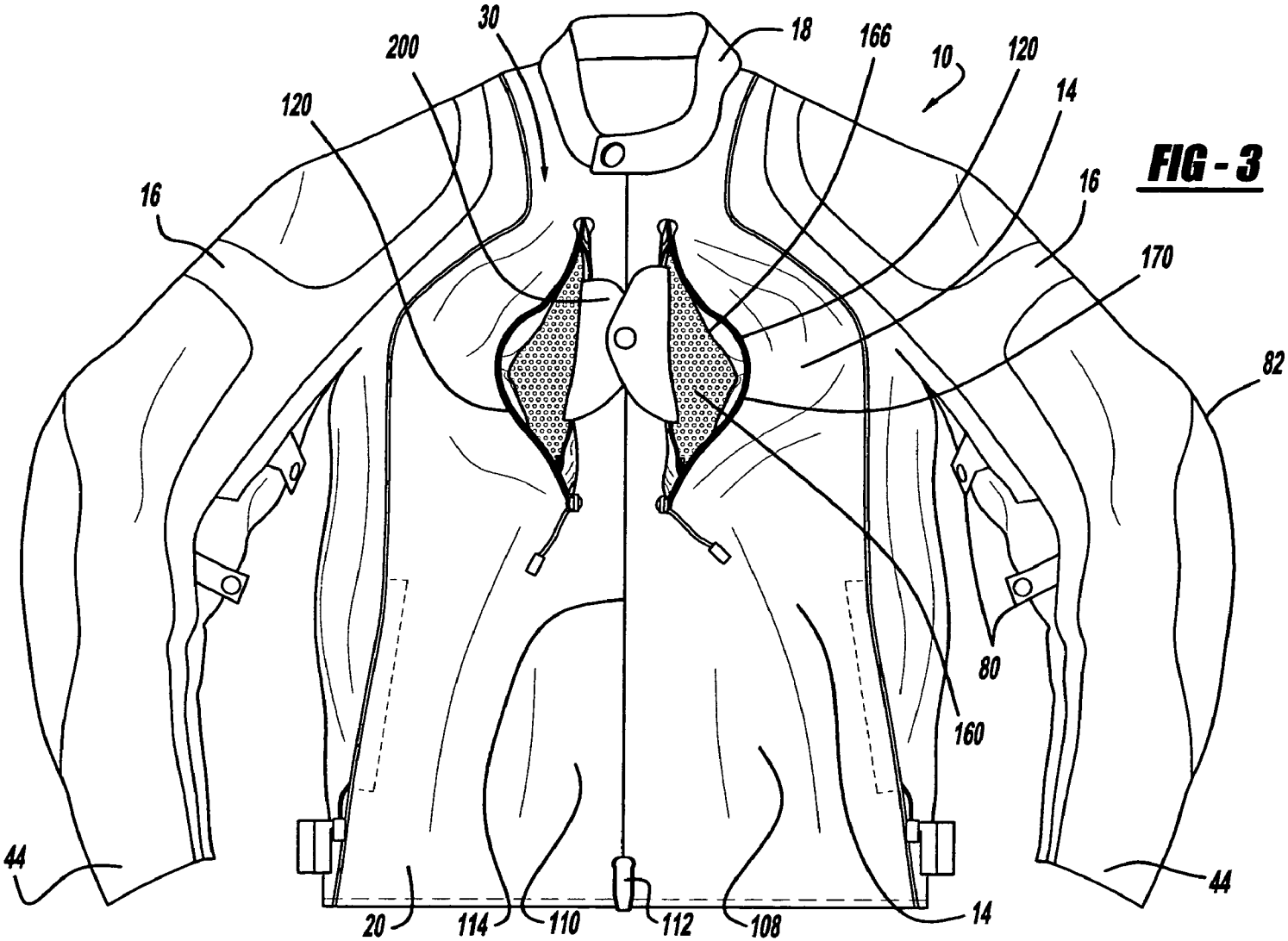
FIG. 3 is a front elevational view of the embodiment shown in FIG. 1 with the pair of front vents opened and a pair of securing straps fastened and secured to expose a breathable material panel.

FIGS. 3 and 4 show front vents 120 in an open position, where first zipper slide 148 is at a terminal end 150 of first zipper closure 140. As shown in FIGS. 2-5 and 11, a panel of breathable material 160 is disposed beneath and in certain aspects, attached to protective material 12 of torso 14, thus corresponding to the region below front vent opening 120. When first closure 140 is in an open position (e.g., when the zipper slide 148 is at a terminal position 150), fluids flow through the panel of breathable material 160 to provide ventilation to the user of jacket 10. Suitable examples of such permeable and breathable materials include polyester or polypropylene mesh fabrics having a plurality of apertures to facilitate air flow.

Figure 5:
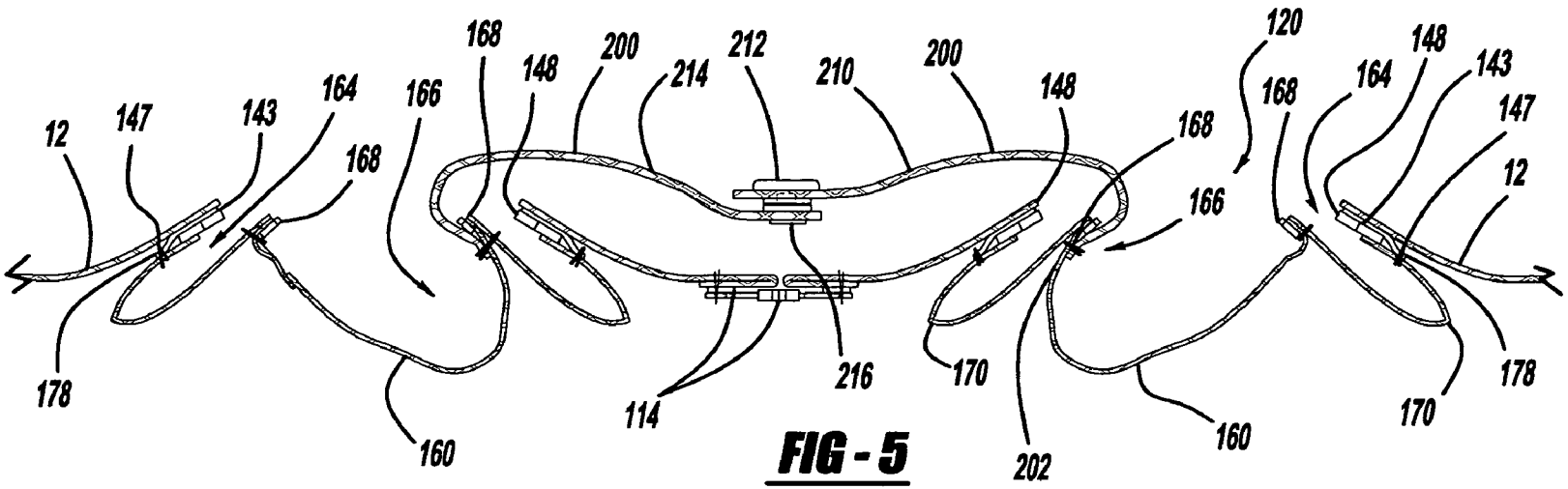
FIG. 5 is a cross-sectional view taken along line 5-5 of FIG. 4.

Front vents 120 are a double-closure configuration that provide enhanced sealing against fluid penetration. The protective material 12 is water-resistant and wind-resistant. Various seams disposed on the exterior of jacket 10 may be susceptible to penetration by fluids, particularly when exposed to high-speed air flow. The seams on the front 30 of jacket 10 in such conditions generally have a greater potential for leakage. As such, the present disclosure provides a double-closure configuration for a vent to essentially prevent water and/or air (e.g., fluids) from migrating through front vent openings 120 when in a closed position (shown in FIGS. 1 and 9) even when driving at high speeds into a strong rain. This concept is best illustrated in FIGS. 4-5 and 10, where front vent 120 includes a primary opening 164 and first closure 140 is a primary closure that is bonded to protective material 12 forming the outer shell 100. Disposed beneath primary opening 164 is a secondary opening 166 with a secondary closure 168. The secondary closure 168 is attached to a secondary membrane 170, which is preferably water-impermeable. The secondary membrane 170 is attached to and disposed within the outer protective material 12, preferably by a water-tight seam 178. Thus secondary membrane 170 forms a gusset-like panel beneath primary opening 164. The secondary membrane 170 is further attached to the panel of breathable material 160. Suitable water-resistant and/or water-proof materials for secondary membrane 170 include nylons, polyurethane-coated polymers (for example, polyesters or polypropylenes), or fluoropolymers, such as expanded polytetrafluoroethylene, such as the commercially available GORE-TEX™ sold by W.L. Gore and Associates of Newark, Del., and the like. Thus, when secondary closure 168 is in a first closed position, secondary membrane 170 provides an additional degree of protection from fluid penetration through secondary vent opening 166 (in addition to the protection provided by first opening closure 148). When a zipper slide of secondary closure 168 is adjusted to an open position, especially when opened in conjunction with first closure 140, fluid flows through front vent opening 120 through both the primary vent opening 164 and the secondary vent opening 166 and through the breathable material panel 160. It should be noted, that an additional degree of control over the amount of fluid entering the front vent 120 is provided by the double-closure configuration, as adjustment of both the primary opening 164 and the secondary opening 166 controls the amount of fluid entering the breathable material panel 160 for ventilation.

Figure 9:
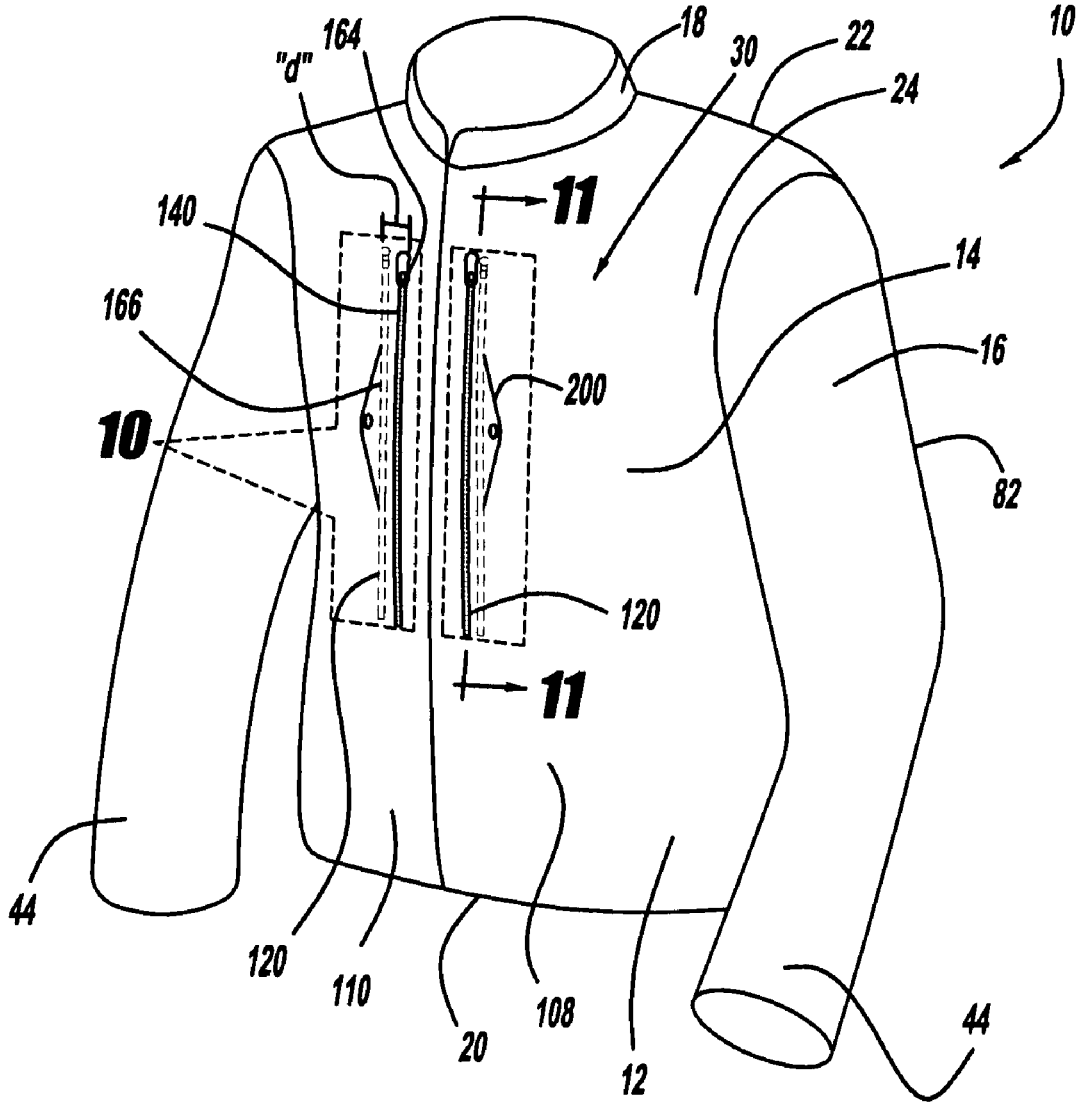
FIG. 9 is a side perspective view showing a simplified representation of the embodiment of FIGS. 1-8 having a detailed depiction of front vents in closed positions.

In a preferred embodiment, additional protection from fluid penetration is provided by positioning the primary opening 164 in a lateral off-set position from the secondary opening 166 disposed beneath it, by off-setting the location of the secondary opening 166 with respect to the primary opening 164. As can be seen in FIG. 9, the primary opening 164 is located a lateral distance "d" from the underlying secondary opening 166, thus lessening direct exposure from any potential fluids that might pass through the primary opening 164 and providing an additional degree of protection from fluid penetration.

Thus, in certain aspects, primary opening 164 is closable by a water-impermeable primary zipper closure 140 that is bonded to the outer protective material 12. Further, secondary opening 166 is disposed within a water-impermeable membrane 170 and is closable by a secondary water-impermeable zipper closure 168. In certain aspects, water-impermeable membrane 170 is attached to a seam formed between primary zipper closure 140 and outer protective material 12. In other aspects, a seam is disposed between breathable material layer 160, secondary zipper closure 168, and impermeable membrane 170.

Figure 11:
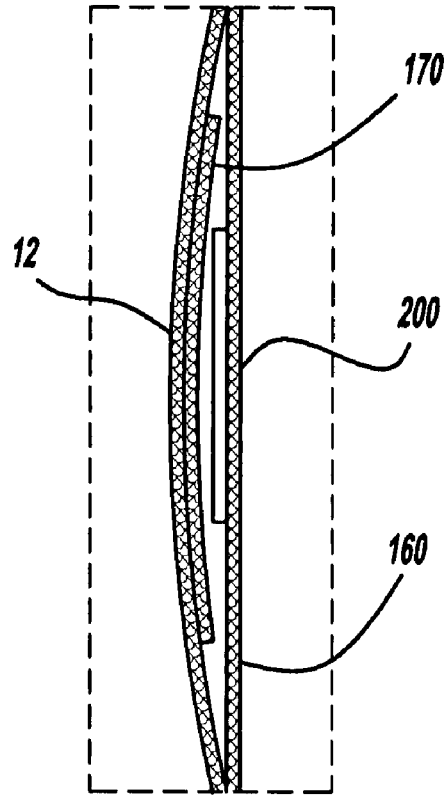
FIG. 11 is a cross-sectional view of the front vents taken along line 11-11 of FIG. 9.

As best shown in FIGS. 2, 3, 4, and 5, one of the front vents 120 (a first front vent 220) further includes a first securing strap 200, which is connected to at least a portion of outer protective material 12, and/or secondary membrane 170 and/or breathable material panel 160. The first front vent 220 is preferably integrated into a seam, for example, a reinforced seam 202, between secondary membrane 170 and breathable material panel 160. A first securing strap 210 is shown here as a triangular flap having a first fastener 212, for example a female snap fastener disposed thereon. Thus, in certain aspects, the first securing component 210 is optionally a flap having at least one edge attached to breathable material panel 160. As shown in FIG. 4, a second securing strap 214 is disposed within a corresponding substantially parallel lateral front vent 120 (second front vent 222) and has a second complementary fastener 216 disposed thereon. When first securing strap 210 is pulled from the first front vent 220, it is extended towards the second securing strap 214, where the first fastener 212 and the complementary second fastener 216 are engaged and thus secured. In this position, the materials (for example, a first zipper track of 148, a portion of outer protective material 12 and secondary membrane 170) are secured tautly beneath the respective first and second extended straps 210, 214 thus increasing the area of exposure of the underlying breathable panel material 160, so that it is substantially exposed, to ensure adequate air flow through front vents 120 and to prevent material from flapping or diminishing exposure of the vents 120. As used herein, "substantially exposed" means that a relatively large surface area of the underlying breathable material panel 160 is unobstructed by overlying materials that might inhibit fluid ingress and egress through the breathable material. In a storage position, where first closure 140 and second closure 168 are respectively in closed positions (thus minimizing and preferably preventing fluid flow into the front vent 120), the securing strap 200 is stored in a region beneath secondary membrane 170 and overlying a portion of breathable material panel 160, such as is shown in FIG. 11.

Figure 8:
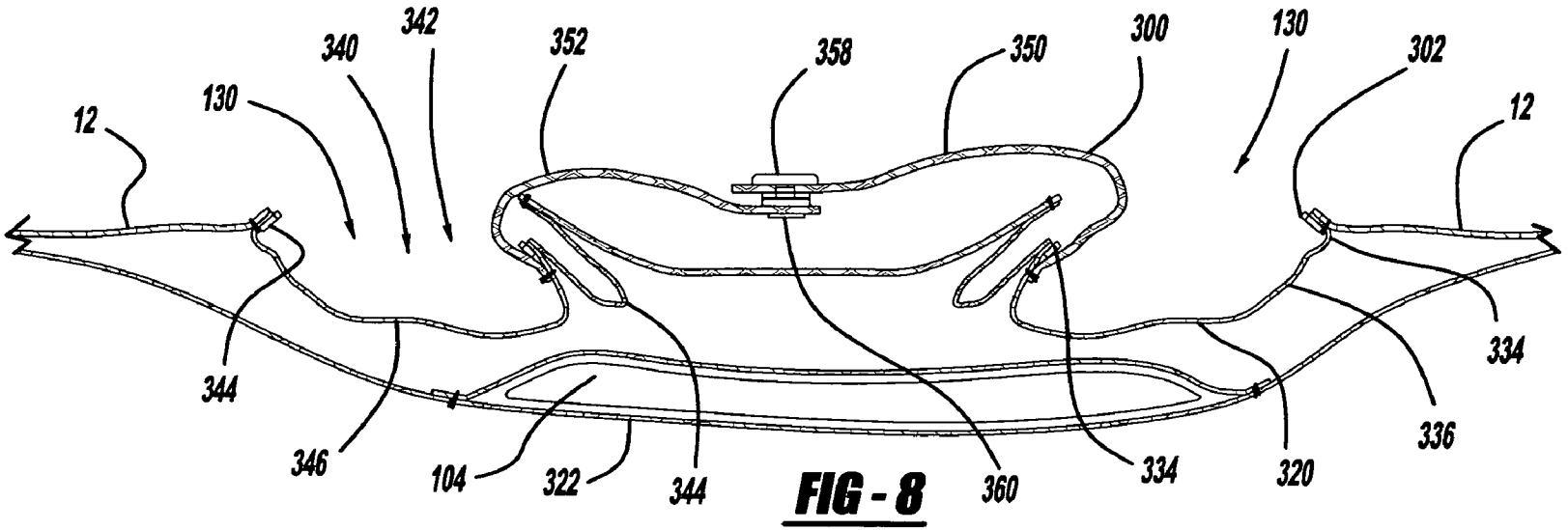
FIG. 8 is a partial cross-sectional view of the pair of rear vents taken along line 8-8 of FIG. 7.

Additionally, the present invention provides back vents 130 employing back securing straps 300, as well. In the embodiment shown in FIG. 8, back vents 130 have a back zipper closure 302 disposed within the outer protective material layer 12 to adjustably open and close the back vents 130, in the manner described in the context of the front vent closures 140. Back vents 130 are spaced apart across the mid-back section 113 of back portion 40 of outer shell 100. As shown in the embodiment of FIG. 8, back vents 130 do not employ the double-closure configuration of front vents 120 (thus, the secondary membrane and secondary closure 170, 168 are absent), but rather have a single water-resistant back closure 302 having a back breathable material panel 320 disposed beneath back vent opening 130. A mesh liner 322 is also optionally attached to the outer protective material 12 and provided below back vent opening 130 and may optionally contain spine protector armor pad 104. A first back vent opening 330 has a first back vent closure 334 and a first back breathable material panel 336. Similarly a second back vent 340 has a second back vent opening 342 with a second back vent closure 344 and a second back breathable material panel 346. A first back extension member 350 is disposed within the first back vent 330, attached to the first back breathable material panel 320. Likewise, a second back extension member 352 is disposed within the second back vent 340. The first back extension member 352 has a first back fastener 358, shown as a female snap fastener, and the second back extension member 352 has a second back fastener 360, a male snap fastener. As shown in FIG. 8, the first and second back extension members 350, 352 can be removably secured via mating of the first back fastener 358 with the complementary second back fastener 360. The first and second back fasteners are a flexible tab structure. A terminal end of the tab is attached to the breathable material layer 320. When first and second back extension members 350, 352 are secured together, the first and second back vent openings 330, 340 are secured in an open position that permits air flow through the first and second back breathable material panels 336, 346. Further, fluid can flow through the permeable intermediate mesh liner 322.

It should be noted that in the context of either the front or back vents, while not shown, an extension member may be secured to a complementary fastener disposed on the external surface of the outer shell 100 rather than with a fastener disposed on an adjacent fastening member. Thus, the present invention contemplates employing extension members according to the present disclosure for use in conjunction with single vents provided on arms, legs, and the like or double-vents provided on arms, legs, and the like, although the disclosed advantages may not be fully realized.

As shown in FIGS. 6 and 9, where a jacket has front and back vents 120, 130, when the vents are in an open position, the breathable material is substantially exposed by use of the securing straps to promote air and fluid flow for two-way ventilation. Thus, the present disclosure provides a vented garment having vented openings with a large surface area exposed to permit greater amounts of fluid to flow through jacket 10 around the wearer, while minimizing billowing and flapping. When the front vents and the back vents are opened and the securing straps, for example, 200, are secured to ensure that the vents are open, air flows from the front of the jacket to the back of the jacket, providing superior two-way ventilation. Yet, various embodiments of the present disclosure provide superior sealing from fluids, especially water.

While various aspects of the present invention have been disclosed, it should be appreciated that variations may be made without departing from the scope of the present disclosure. For example, as previously described, outer shell 100 may include a thermally insulating layer sewn to the inside thereof, containing polyester fiber batting, foam or goose down, for protection against cold weather; in this variation, a lightweight shell fabric (with less abrasion resistance) of about 70 denier would be used with insulation of about 70 to 200 grams. Furthermore, it is alternately envisioned that a fleece or other non-mesh, yet air permeable, material can be substituted in place of the breathable material panels (e.g., 160, 320). Moreover, snap, hook and loop, interlocking barb, button and other disengageable fasteners can be employed instead of the preferred zipper closures and snap fastening members, although some of the wind deterrent benefits of the present disclosure may not be realized. Shirts, pants, and other such garments may readily employ certain aspects of the present disclosure, although some of the advantages of the present disclosure may not be achieved. Similarly, the securing straps may take a variety of forms and fasteners, yet again some of the advantages of the present disclosure may not be realized.

Furthermore, various materials have been disclosed in an exemplary fashion, but other materials may of course be employed, although some of the advantages of the present disclosure may not be realized. It is intended by the following claims to cover these and any other departures from the disclosed embodiments which fall within the true spirit of the invention.

What is claimed is:

1. A ventilated garment comprising:

at least one vent disposed in a wind-resistant material layer;

a closure moveable from a first position inhibiting fluid from entering said at least one vent to a second position permitting fluid to enter said at least one vent;

a breathable material layer underlying said at least one vent; and a securing strap comprising a first fastening member that is removably engageable with a complementary second fastening member, wherein said securing strap is movable between a secured position corresponding to said at least one vent being in said second position, where said first fastening member is engaged with said complementary second fastening member to substantially expose said breathable material layer to promote fluid flow therethrough and an unsecured position when said closure is in said first position securing strap is stowed in a region between said breathable material layer and said wind-resistant material layer, wherein said at least one vent comprises a primary opening and a secondary opening that is disposed beneath said primary opening and above said breathable material layer, said primary opening closable by a primary closure that is attached to said wind-resistant material and said secondary opening is disposed within a water impermeable membrane and is closeable by a secondary closure.

2. The ventilated garment of claim 1 wherein the ventilated garment further comprises a pair of vents including a first vent and a second vent, wherein said securing strap is a first securing strap associated with said first vent, and said second vent comprises a second additional securing strap comprising said complementary second fastening member, wherein said second additional securing strap is movable between an unsecured position for stowing within a region between a second permeable material and said wind-resistant material layer and a secured position wherein said complementary second fastening member is engaged with said first fastening member.

3. The ventilated garment of claim 1 wherein said at least one vent is disposed on a torso of a jacket selected from at least one of a front region and a back region.

4. The ventilated garment of claim 1 wherein said first fastening member is selected from a female or male snap fastener and said complementary second fastening member is selected from the other of said female or male snap fastener.

5. The ventilated garment of claim 1 wherein said primary opening is laterally offset from said secondary opening.

6. The ventilated garment of claim 5 wherein said primary closure is a primary water-impermeable zipper closure that is bonded to said wind-resistant material layer and said secondary closure is a secondary water-impermeable zipper closure.

7. The ventilated garment of claim 1 wherein said wind-resistant material layer comprises a nylon material and said breathable material layer comprises a mesh fabric comprising polyester.

8. The ventilated garment of claim 1 wherein said securing strap is selected from a tab having a terminal end attached to said breathable material layer or a flap having an edge attached to said breathable material layer.

9. A ventilated motorcycle garment comprising:

at least one pair of substantially parallel vents disposed in a wind-resistant material layer;

a closure for each respective vent of said pair, each said closure respectively moveable from a first position inhibiting fluid from entering said vent to a second position promoting fluid to enter said vent;

a breathable material layer underlying each said vent of said pair; and a first securing strap comprising a first fastening member and a second securing strap comprising a second complementary fastening member, wherein said first fastening member is removably engaged with said second complementary fastening member, wherein each said securing strap is movable between a secured position when said respective vents are in said second position and said first fastening member is engaged with said second complementary fastening member to substantially expose said respective breathable material layers promoting fluid flow therethrough and each said securing strap is moveable to an unsecured position for stowing in a region between said breathable material layer and said wind-resistant material layer.

10. The ventilated motorcycle garment of claim 9, wherein said at least on pair of parallel vents further respectively comprises a primary closable opening and a secondary closable opening disposed beneath said primary opening and above a breathable material, wherein said primary opening is laterally offset from said secondary opening.

11. The ventilated motorcycle garment of claim 10 wherein said primary opening is closable by a primary water-impermeable zipper closure that is bonded to said wind-resistant material and said secondary opening is disposed within a water-impermeable membrane and is closable by a secondary water-impermeable zipper closure.

12. The ventilated motorcycle garment of claim 9 wherein in said secured position, said first securing strap and said second securing strap are taut over a region between said pair of substantially parallel vents.

13. The ventilated motorcycle garment of claim 9 wherein said pair of vents is disposed on a torso of a jacket selected from a front region and/or a back region.

14. The ventilated motorcycle garment of claim 9 wherein said first fastening member is selected from a female or male snap fastener and said second complementary fastening member is selected from the other of said female or male snap fastener.

15. The ventilated motorcycle garment of claim 9 wherein said wind-resistant material layer comprises a nylon material and said breathable material layer comprises a mesh fabric comprising polyester.

16. A ventilated jacket comprising:

at least one pair of substantially parallel closable front vents disposed in a wind-resistant material layer in a front of the jacket, wherein each said closable front vent has a breathable material layer disposed beneath it, wherein one of said pair of front vents comprises a first securing strap comprising a first fastening member and the other of said pair of front vents comprises a second securing strap comprising a second complementary fastening member, wherein said first fastening member is removably engaged with said second complementary fastening member to substantially expose said respective breathable material layer beneath each said front vent to permit fluid flow therethrough and wherein said first and said second securing straps are optionally stowed in a region between said breathable material layer and said wind-resistant material layer when in an unsecured position.

17. The ventilated garment of claim 16 wherein said at least one pair of substantially parallel closable front vents comprises a primary opening and a secondary opening disposed beneath said primary opening and above said breathable material layer.

18. The ventilated garment of claim 17 wherein said primary opening is laterally offset from said secondary opening.

19. The ventilated garment of claim 17 wherein said primary opening is closable by a primary water-impermeable zipper closure that is bonded to said wind-resistant material and said secondary opening is disposed within a water-impermeable membrane and is closable by a secondary water-impermeable zipper closure.

* * * * *

UNITED STATES PATENT AND TRADEMARK OFFICE

CERTIFICATE OF CORRECTION

PATENT NO. : 8,001,618 B2
APPLICATION NO. : 11/903444
DATED : August 23, 2011
INVENTOR(S) : Marc A. Bay It is certified that error appears in the above-identified patent and that said Letters Patent is hereby corrected as shown below:

Col. 11, line 37 should read: "said at least ~~on~~one pair of parallel vents further respectively"

Col. 12, line 36 should read: "prises a primary opening and a secondary opening disposed"

Signed and Sealed this
Fourth Day of October, 2011

David J. Kappos

David J. Kappos
*Director of the United States Patent and Trademark Office*